US005672122A

United States Patent [19]

Strong

[11] Patent Number: 5,672,122

[45] Date of Patent: Sep. 30, 1997

[54] ADJUSTABLE GOLF TEE

[75] Inventor: Paul G. Strong, Hidden Hills, Calif.

[73] Assignee: Poly-Tainer, Inc., Simi Valley, Calif.

[21] Appl. No.: 755,242

[22] Filed: Nov. 22, 1996

Related U.S. Application Data

[63] Continuation of Ser. No. 498,035, Jul. 3, 1995, abandoned.

[51] Int. Cl.[6] ..... A63B 57/00

[52] U.S. Cl. ..... 473/398; 473/400

[58] Field of Search ..... 473/386, 387, 473/388, 389, 390, 391, 392, 393, 394, 396, 397, 398, 399, 400, 401, 402

[56] References Cited

U.S. PATENT DOCUMENTS

| | | | |
|---|---|---|---|
| 1,593,480 | 7/1926 | Thompson | 273/202 |
| 1,616,059 | 2/1927 | Mulvehill | 273/202 |
| 3,114,557 | 12/1963 | Cabot | 273/202 |
| 3,203,700 | 8/1965 | Antonious | 273/202 |
| 3,408,079 | 10/1968 | Kirikos | 273/202 |
| 5,356,146 | 10/1994 | Blosser | 273/202 |

FOREIGN PATENT DOCUMENTS

| | | | |
|---|---|---|---|
| 2671976 | 7/1992 | France | 273/33 |

*Primary Examiner*—Steven B. Wong
*Attorney, Agent, or Firm*—Elliott N. Kramsky

[57] ABSTRACT

A golf tee includes an elongated member and a disk-like member for fixation orthogonal thereto. The elongated member includes a plurality of notches along its length and the disk-like member has a central aperture with bevelled internal edge for coaction therewith. The notches are arranged at a predetermined section of the elongated member so that the disk, which acts as a stop, can fix the height of the ball at an optimum position with respect to one of a plurality of standard golf club heads.

9 Claims, 1 Drawing Sheet

FIG. 1
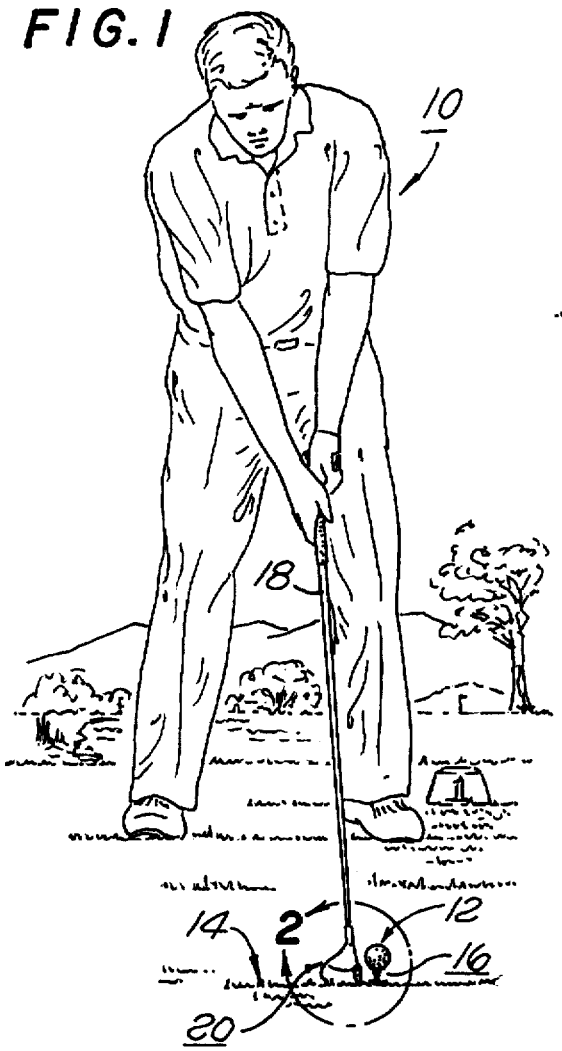
FIG. 2
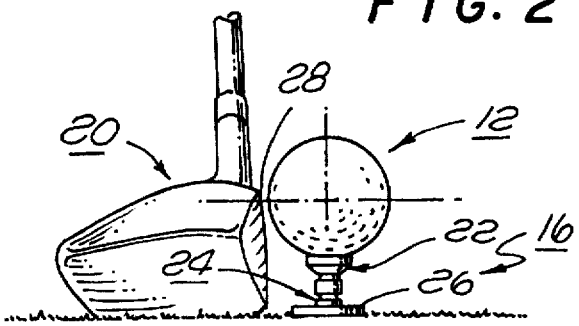
FIG. 3
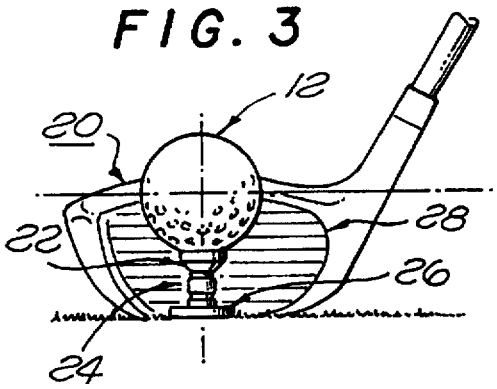
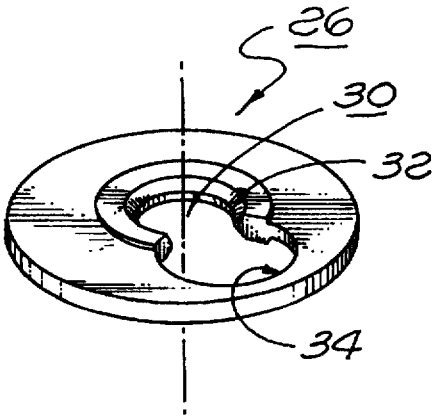
FIG. 4
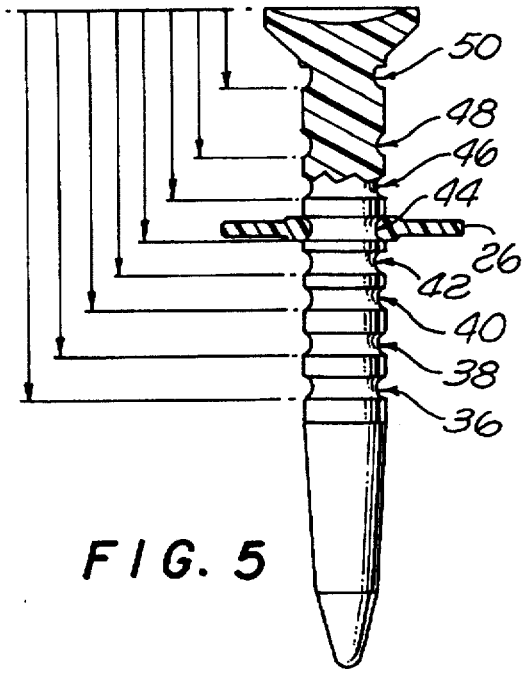
FIG. 5

ADJUSTABLE GOLF TEE

This application is a continuation of Ser. No. 08/498,035, filed Jul. 3, 1995, now abandoned.

BACKGROUND

1. Field of the Invention

The present invention relates to golf equipment. More particularly, this invention pertains to an improved tee for vertically positioning a golf ball prior to contact with a club head.

2. Description of the Prior Art

Golf, one of the most revered of all participant sports, employs three main instrumentalities in "attacking" a course. These include the ball, a set of clubs and a tee for adjusting the vertical position of the ball with respect to the club head.

Golf tees are conventionally fabricated of wood or plastic, including a cup-like upper end and a pointed or tapered opposed end for insertion into the turf. With the exception of some very short holes, each hole of a regulation course is begun by hitting a ball off such a tee.

Golf is recognized to be a psychological, as well as physical, game. Even expert golfers can be "spooked" by slight changes and suffer dire consequences to their scores. It is recognized that the height of a golf ball with respect to the club head affects both the height and the distance of the golf shot. Since almost every hole is begun off a tee, it is therefore highly desirable to provide the golfer with assurance beforehand that the ball is teed to a proper height with respect to the club head.

Unfortunately, the conventional golf tee leaves the height of the golf ball subject to many factors. These include the golfer's "eye", his "feel" and the composition of the soil. This introduces additional "skill" factors into the game and leaves the golfer with worries and distractions as he addresses the ball at the beginning of each hole.

SUMMARY OF THE INVENTION

The present invention addresses the foregoing shortcomings of the prior art by providing apparatus for vertically positioning a golf ball for contact with a club head. Such apparatus includes an elongated member. The elongated member has a cup at one end for receiving a golf ball and is tapered at the opposed end for insertion into a playing surface. The member is symmetrical about an axis joining the opposed ends. A disk-like member is provided. Means are provided for adjustably fixing the disk-like member orthogonal to the elongated member at predetermined locations along the axis to act as a stop for positioning the cup at predetermined heights above the playing surface.

The foregoing and additional features and advantages of this invention will become further apparent from the detailed description that follows. Such detailed description is accompanied by a set of drawing figures. Numerals of the drawing figures, corresponding to those of the written description, point to the various features of the invention. Like numerals refer to like features throughout both the written text and the drawing figures.

BRIEF DESCRIPTION OF THE DRAWINGS

FIGS. 1 is a view of a golfer addressing a ball positioned on a tee in accordance with the invention;

FIG. 2 is an enlarged side elevation view illustrating a golf ball positioned upon a tee in accordance with the invention and illustrating the relationship of the ball to a known golf club head;

FIG. 3 is an enlarged frontal view showing a golf ball seated upon a tee in accordance with the invention and demonstrating again the predetermined vertical position thereof with respect to a known golf club head;

FIG. 4 is a perspective view of the disk-like member that acts as a vertical stop for determining vertical position in a tee in accordance with the invention; and FIG. 5 is a side sectional view of a golf tee in accordance with the invention including coacting elongated and disk-like members.

DETAILED DESCRIPTION OF THE PREFERRED EMBODIMENT

Turning to the drawings, FIG. 1 is a view of a golfer 10 in the act of addressing a golf ball 12 positioned at a predetermined height above a playing surface 14 by means of a tee 16 in accordance with the invention. As can be seen in this view, the golfer 10 grasps a golf club 18 that includes a head 20 at its distal end for contacting the ball 12. It is well known that there exist numerous types of golf club heads, both "irons" and "woods", and that such golf club heads are characterized by surfaces for contacting the ball of differing sizes (i.e. distance from the bottom or "heel" of the club head to the top of the contact surface.)

FIG. 2 is an enlarged side elevation view taken at line 2 of FIG. 1. This view illustrates in detail the golf ball 12 positioned upon the tee 16 of the invention. As can be seen in this view, the golf tee 16 includes a conventional cup 22 at the upper end of a generally-cylindrically elongated member 24 for receiving the golf ball 12. Also shown in this view is a disk-like member 26 that coacts with a predetermined notch of the elongated member 24 acting as a stop for setting the height of the cup 22 above the playing surface 14. As can be seen in FIG. 2, the club head 20 includes a well-defined hitting surface 28.

Referring to FIG. 2 in conjunction with FIG. 3, an enlarged frontal view of the golf ball 12 seated upon the tee 16, the height of the cup 22 of an optimally-positioned tee locates the golf ball 12 with respect to a given club head 20 so that approximately one half of the ball lies above the hitting surface 28. It will be seen below that notches located along the length of the elongated member 24 of the tee for receiving the disk-like member 26 are chosen with regard to "standard" club head sizes. As such, for a club head of a given standard size, there exists a notch such that, by fitting the disk-like member 26 therein, a golf ball seated within the cup 22 will lie at a height whereby the top half of a golf ball lie above the face of the club head. This permits the golfer to select a setting for the disk-like member that will guarantee perfect positioning of the golf ball with respect to that club head.

FIG. 4 is a perspective view of the disk-like member 26, discussed above, that acts as a vertical stop for determining the height of the cup 22 above a playing surface. A central aperture 30 of the disk-like member 26 includes a bevelled inner surface 32 for tightly fitting the member 26 in a notch of the elongated member 24. This is shown clearly in FIG. 5, a side sectional view of a golf tee in accordance with the invention.

As can also be seen in FIG. 4, the disk-like member 26 has an offset internal aperture 34. This aperture 34 is provided for facilitating adjustment of the position of the disk-like member 26 with respect to the elongated member 24. Referring again to FIG. 5 in conjunction with FIG. 4, the diameter of the offset interior aperture 34 exceeds that of the elongated member 24. As such, should the golfer wish to adjust the height of the ball upon the tee, he may accomplish this by pushing the disk-member 26 in a direction orthogonal to the longitudinal axis of the elongated member 24 to disengage it from the member 24 and to position the offset internal aperture 34 concentric with the axis of the elongated member 24. Since the diameter of the offset internal aperture 34 exceeds the outer diameter of the elongated member 24, the disk-like member 26 may then be moved freely to other notch positions to affect repositioning and consequent resetting of the height of the cup 22 above the disk-like member 26. Once the disk-like member 26 is moved to a selected notch, it can then be engaged by pushing the disk-like member 26 so to again decenter the aperture 34 and reengage the bevelled inner surface of the central aperture 36.

As seen in FIG. 5, notches 36, 38, 40, 42, 44, 46, 48 and 50 are irregularly-spaced along the length of the elongated member 24 for providing predetermined points of engagement of the disk-like member 26 with the elongated member 24. As mentioned earlier, the locations of the notches 36 through 50 have been selected with respect to standard golf club heads to permit optimal positioning of the golf ball with respect to each.

The golf tee of the invention is formed of resilient material, preferably a soft plastic that includes a biodegradable material such as corn starch and will not mark a driver or an iron. Thus, the tee will not damage either clubs or the blades of golf course lawnmowers. The tee may be fabricated of a color-coded plastic. In this way, the golfer can adjust a number of tees for use with particular club heads and can have confidence in the use of a variety of club heads off the tee.

While the invention has been described with reference to its presently-preferred embodiment, it is not limited thereto. Rather, this invention is limited only insofar as it is defined by the following set of patent claims and includes within its scope all equivalents thereof.

What is claimed is:

1. Apparatus for positioning a golf ball at a selectable plurality of heights, each of said heights being the optimum position for contact with the hitting surface of at least one of a predetermined array of golf clubs, said apparatus comprising, in combination:

a) a generally cylindrical elongated member;

b) said member having a cup at one end for receiving a golf ball and being tapered at the opposed end for insertion into a playing surface;

c) said member being symmetrical about an axis joining said opposed ends;

d) a disk-like member including a bevelled central aperture and a substantially circular offset internal aperture whose diameter exceeds that of said elongated member;

e) said elongated member including a plurality of circumferential notches spaced unevenly along said axis, each of said notches being arranged to receive said bevelled central aperture of said disk-like member, whereby said member can act as a stop that determines the height of said cup above a playing surface; and f) each of said notches being located at a position along said elongated member selected in relation to the height of the hitting surface of at least one of said predetermined golf clubs so that said golf ball can be optimally positioned with respect to the hitting surface of said golf club.

2. Apparatus as defined in claim 1 wherein said disk-like member is of resilient material.

3. Apparatus as defined in claim 2 wherein said elongated member and said disk-like member are of soft plastic.

4. Apparatus as defined in claim 3 wherein said elongated member and said disk-like member are of biodegradable plastic.

5. Apparatus as defined in claim 4 wherein said elongated member and said disk-like member are color-coded.

6. Apparatus as defined in claim 1 wherein each of said notches is arranged so that, when said disk-like member is received within one of said notches, said apparatus will position said golf ball so that one-half of said ball lies above the hitting surface of a golf club head.

7. Apparatus as defined in claim 1 wherein eight notches are located along said elongated member.

8. Apparatus as defined in claim 6 wherein the distance between each of said notches and said cup is approximately equal to the height of the hitting surface of a golf club head minus the radius of a golf ball.

9. Apparatus as defined in claim 7 wherein the spacing between the uppermost notch and the adjacent notch exceeds that between any other adjacent pair of notches.

* * * * *